US009010499B2

(12) United States Patent
McCarthy et al.

(10) Patent No.: US 9,010,499 B2
(45) Date of Patent: Apr. 21, 2015

(54) MULTI-CAR ELEVATOR HOISTWAY SEPARATION ASSURANCE

(75) Inventors: Richard C. McCarthy, Simsbury, CT (US); Richard Peruggi, Glastonbury, CT (US); Randall K. Roberts, Hebron, CT (US); Greg A. Schienda, Plantsville, CT (US); Harold Terry, Avon, CT (US); Gilbert W. Wierschke, Littleton, CO (US)

(73) Assignee: Otis Elevator Company, Farmington, CT (US)

( * ) Notice: Subject to any disclaimer, the term of this patent is extended or adjusted under 35 U.S.C. 154(b) by 988 days.

(21) Appl. No.: 12/303,292

(22) PCT Filed: Jun. 7, 2006

(86) PCT No.: PCT/US2006/022222

§ 371 (c)(1),
(2), (4) Date: Dec. 3, 2008

(87) PCT Pub. No.: WO2007/145613

PCT Pub. Date: Dec. 21, 2007

(65) Prior Publication Data

US 2009/0194371 A1 Aug. 6, 2009

(51) Int. Cl.
*B66B 1/34* (2006.01)
*B66B 5/00* (2006.01)

(52) U.S. Cl.
CPC ..... *B66B 1/3492* (2013.01); *B66B 5/0031* (2013.01)

(58) Field of Classification Search
USPC ..... 187/247, 248, 249, 380–388, 391–393
See application file for complete search history.

(56) References Cited

U.S. PATENT DOCUMENTS

| | | | | | |
|---|---|---|---|---|---|
| 1,973,920 | A * | 9/1934 | Wilson | 187/249 |
| 5,663,538 | A * | 9/1997 | Sakita | 187/382 |
| 5,865,274 | A * | 2/1999 | Kiji et al. | 187/380 |
| 5,877,462 | A * | 3/1999 | Chenais | 187/249 |
| 6,871,727 | B2 * | 3/2005 | Jokela et al. | 187/383 |
| 7,178,635 | B2 * | 2/2007 | Meissner et al. | 187/249 |
| 7,353,912 | B2 | 4/2008 | Reuter et al. | |
| 7,389,857 | B2 * | 6/2008 | Hikita | 187/249 |
| 7,621,376 | B2 * | 11/2009 | Duenser et al. | 187/249 |
| 7,729,806 | B2 | 6/2010 | Ohira | |
| 7,819,228 | B2 * | 10/2010 | Terry et al. | 187/249 |
| 7,841,450 | B2 * | 11/2010 | Smith et al. | 187/249 |
| 2005/0082121 | A1 | 4/2005 | Deplazes | |

OTHER PUBLICATIONS

Extended European Search Report for Application No. EP 06 76 0730 dated Apr. 5, 2012.

* cited by examiner

*Primary Examiner* — Anthony Salata
(74) *Attorney, Agent, or Firm* — Carlson, Gaskey & Olds

(57) ABSTRACT

A pair of elevator cars (10, 11) traveling in the same hoistway have their positions sensed (20-23, 29-32) to provide for each a position signal (35, 37) from which velocity signals (64, 65) are derived; lookup tables (66, 61) of safe stopping distance (B, S) for braking and safeties are formed as a function of all possible combinations of velocity (V(U), V(L)) of said cars. Comparison of safe stopping distances for contemporaneous velocities of said cars with actual distance between said cars provides signals (85, 98, 99) to drop the brakes (49, 50) of one or more of the cars, and provides signals (82) to engage the safeties (18, 18*a*, 19, 19*a*) of all cars if the cars become closer or if acceleration detectors (117, 118) determine a car to be in freefall.

1 Claim, 2 Drawing Sheets

MULTI-CAR ELEVATOR HOISTWAY SEPARATION ASSURANCE

TECHNICAL FIELD

This invention relates to a plurality of elevators operating in a single hoistway, current safe stopping distance between adjacent cars is determined for all possible speeds of both cars, both for braking and for stopping by means of safeties; actual distance between adjacent cars is periodically or continuously compared therewith; the brakes of one or more of the cars are engaged in response to determining a failure of other separation assurance measures, and the safeties of the cars are engaged in response to determination of likely brake failure, or in case of a car in freefall.

BACKGROUND ART

It is known to reduce the space required for elevator service in a building by providing more than one elevator car traveling in each elevator hoistway. If call assignments are limited and rudimentary, the avoidance of collisions between cars can be assured. However, such systems do not add significant service since many calls cannot be assigned. Examples are illustrated in U.S. Pat. Nos. 5,419,914, 6,360,849 and U.S. 2003/0164267.

In U.S. Pat. No. 5,877,462, elevator stop requests are processed to ensure that one car does not reach a stopping floor while another car will still be there, in accordance with a speed versus position profile applicable to both cars.

In order to cause the service achieved by several cars in one hoistway to approach the level of service which may be achieved by cars in several hoistways, it is necessary not only to assure that the cars will remain separated, but also permit the cars a maximal amount of movement in responding to calls for service.

DISCLOSURE OF INVENTION

Objects of the invention include: safely maximizing elevator service provided by more than one car traveling in a single hoistway; freedom of movement of a plurality of cars answering calls in a single hoistway, while separation of cars is assured; stopping multiple cars in a hoistway if one car is in free fall; and improved elevator service employing a plurality of cars traveling in the same hoistway.

According to the present invention, indications of safe stopping distance are determined for all speed combinations of a pair of adjacent cars operating in the same hoistway; actual distance between adjacent cars is continuously compared with the predetermined safe distance; a first level indication occurs when other car separation software (or hardware) has failed; this will cause the brake of one or more cars to be engaged; and a second level indication occurs when the brakes have not prevented adjacent cars from becoming more closely spaced, generally due to brake failure; the safeties of both cars are engaged in that case.

The comparison may be made by access to one or more tables created from a formula, or by processing data in real time, if desired.

Although disclosed as engaging the brakes of a car only if that car's velocity exceeds a threshold, the invention may be practiced utilizing that or another criteria for determining if only one car or more than one car should have brakes applied in response to the first level indication.

According to the invention further, acceleration sensors detect a car in freefall and engage the safeties of all cars in a multi-car hoistway.

Other objects, features and advantages of the present invention will become more apparent in the light of the following detailed description of exemplary embodiments thereof, as illustrated in the accompanying drawing.

MODE(S) FOR CARRYING OUT THE INVENTION

Figure 1:
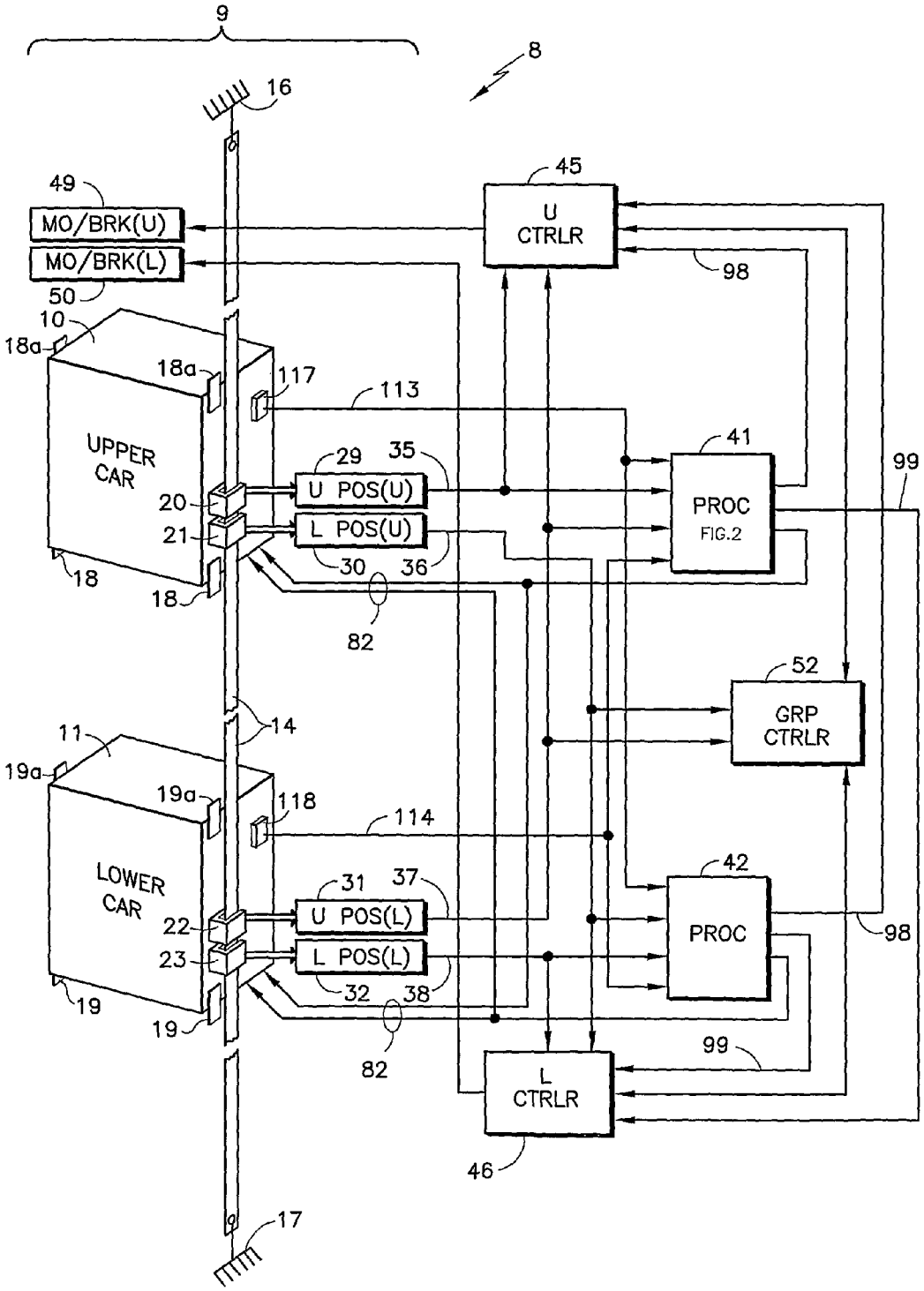
FIG. 1 is a partial, perspective view of a pair of elevator cars traveling in the same hoistway and a related block diagram of apparatus which may incorporate the present invention.

Referring to FIG. 1, an elevator system 8 having a hoistway 9 includes an upper car 10 and a lower car 11 both traveling within the hoistway 9. In the hoistway there is a durable steel encoded tape, such as a stainless steel tape 14 with code punched therein. The tape 14 extends between two fixed parts 16, 17 of the hoistway. Each car has conventional bidirectional safeties 18, 18*a*, 19, 19*a*, which operate in a conventional fashion against both of the guide rails (not shown). However, counterweight safeties may be used in place of the lower safeties 18, 19 or other forms of safeties may be used.

On each elevator car there are two tape readers: an upper (U) tape reader 20 and a lower (L) tape reader 21 on the upper car 10, and upper and lower tape readers 22, 23 on the lower car 11. Each of the tape readers and corresponding associated circuitry 29-32 provide information 35-38 of the position of the upper car and the lower car to redundant processors 41, 42, as well as to an upper car controller 45 and lower car controller 46. The processors 41, 42 may operate the brake of either car's motor/brake system 49, 50 or engage the safeties of the upper car and the lower car, whenever the cars are in a dangerous spacing/speed relationship, as described with respect to FIG. 2. Instead of steel tape, vanes mounted to the hoistway or landing may be read magnetically or optically by devices mounted on the car to provide position/velocity feedback. Forms of position/velocity feedback may be used.

Figure 2:
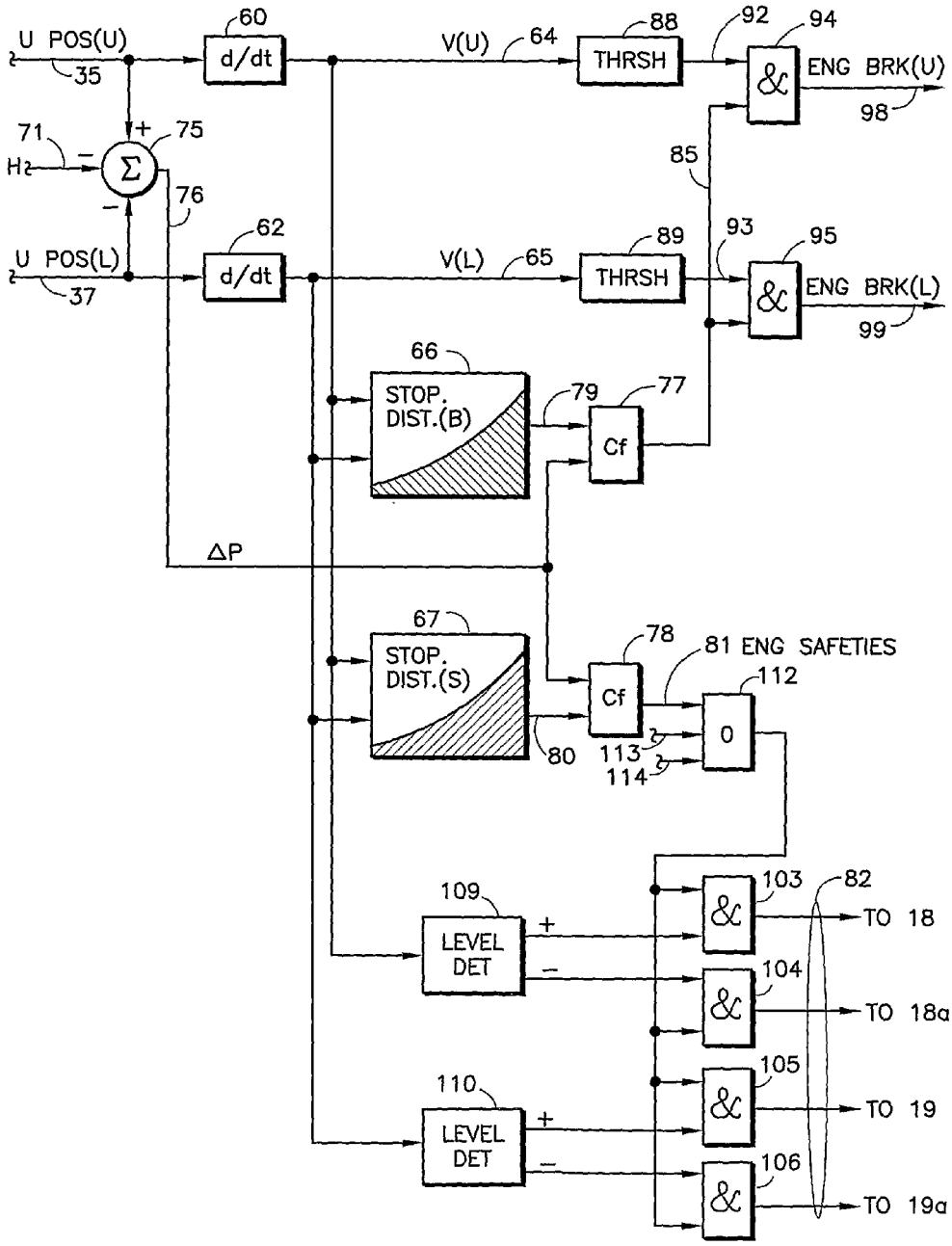
FIG. 2 is a functional schematic illustrating operational principles of the present invention.

Referring to FIG. 2, the upper car position signal on the line 35, U POS (U), developed from the upper position sensor 20 on the upper car 10, is fed to a differentiator 60, and a signal on a line 37 indicating the lower car position, U POS(L), developed from the upper position sensor 22 on the lower car 11 is fed to a differentiator 62. This provides an upper car velocity signal, V(U), on a line 64 and a lower car velocity signal, V(L), on a line 65.

Conventions are adopted that upward travel corresponds to positive velocity and downward travel corresponds to negative velocity, and that positions in the hoistway are all positive. Of course, when the cars are traveling away from each other in opposite directions, or one car is traveling away from the other car when the other is stopped, a danger is not presented.

The disclosed embodiment of the present invention assumes that both car dispatching (assignment of calls to cars) and motion control of the cars in the same hoistway are designed to operate multiple cars, normally, in such a fashion that they will not interfere with each other, that is, will not collide. The present invention takes into account the possibility that software or hardware failures may cause the designed safe operation of the cars to become unsafe, which the present invention will detect and accommodate by means of the brakes or safeties of the cars.

The embodiment described herein is presented in a simple form, in which tables are generated, as described hereinafter, to determine the minimal braking distance, Stopping Distance (B), for recognizing a failure in the normal controls of the elevators which has resulted in the cars becoming too close to each other for safety. If the cars are closer than this braking distance, the brake of one or both of the adjacent cars will be applied. These tables are developed is as a function of a plurality of fixed values and as a function of the velocity of the upper car as well as the velocity of the lower car. As illustrated in the following equation, the Stopping Distance (B), which may indicate that brakes should be applied, is determined for all possible combinations of velocities of the upper and lower cars, employing a factor, Δt, which is a period of time representing the time it takes for the brakes to be engaged after a determination of a safety problem has been made; it may be typically on the order of a few hundred milliseconds. This is a fixed factor in the generation of the tables.

$$\text{Stopping Distance}(B) = V(U)\Delta t + 1/2A(U)\Delta t^2 + [V(U) + A(U)\Delta t]^2/2D(U) + V(L)\Delta t + 1/2A(L)\Delta t^2 + [V(L) + A(L)\Delta t]^2/2D(U) + K(B)$$

Where K(B)=a braking distance bias constant, which is optional

V=velocity

A=acceleration, assumed from car overbalance

D=deceleration=$[F(B)-W_o]/m$

Where F(B)=force applied by brakes $W_o$=overbalance ((net) weight of car m=mass of car plus counterweight The first term is the velocity of the upper car times Δt.

The second term employs a factor, A(U), which represents an assumed acceleration of the upper car in the event that the motor of the upper car looses control of the car, even though the car is still roped through the sheave to the counterweight. This factor is a function of the overbalance difference in weight between the empty car and the counterweight, which herein is assumed to be the same as the difference in weight between a full car and the counterweight. The second term is one-half of the acceleration of the upper car, A(U), times the square of the elapsed time factor.

The third term of the equation is the square of the sum of the upper car velocity, V(U), with the product of the upper car acceleration, A(U), times the delay factor, Δt, all divided by twice the assumed deceleration, D(U), of the upper car. The assumed deceleration is derived from the stopping force, F(B), which the brakes can apply, which is determined for the car either empirically or analytically as the difference between the brake stopping force, F(B), and the overbalance or net weight of the car and counterweight, ($W_o$), all divided by the total mass, m. of the car and the counterweight.

The next three terms are the same as the first three terms, except they utilize values related to the lower car, (L).

In the seventh term of the equation, K(B) is a braking distance bias constant, that is, an extra measure of distance which is added to the value calculated by the first six terms of the equation, for extra assurance of safety. The term "safe braking distance" does not preclude a distance which is a predetermined amount greater than the minimum safe braking distance, with or without the bias constant. This fact is inherent due to the need to brake safely once the cars are closer to each other than the "safe braking distance".

The safe braking distance, Stopping Distance (B), for all possible combinations of velocity of the upper car and lower car are determined by the equation and utilized to form a table which can be accessed to determine, at any moment in time, the present safe braking distance as a function of the current velocity of the upper car and the current velocity of the lower car. Such a table 66 is shown in FIG. 2, which represents operation within processor 41.

The safe stopping distance required for the cars to stop if the safeties are engaged, Stopping Distance (S), is calculated in the same fashion as described with respect to the braking distance, except that the force used to calculate deceleration is the force F(S) which the safeties will apply when engaged, and a different bias constant, K(S), may be used or omitted. Should the brakes be applied and the cars not respond properly, the cars thereby become closer to each other than is indicated by Stopping Distance (S); it is assumed that the brakes have failed, and the safeties must be employed to prevent the cars from coming any closer to each other. Calculation of Stopping Distance (S), in the manner described hereinbefore, for all possible combinations of velocities of the upper car and lower car are formulated into a table 67 in FIG. 2.

The position sensors 20, 22 as well as the position sensors 21, 23 are separated by a distance, H, between the adjacent cars. If the safe braking distance and safe stopping distance are taken to be about zero when the cars are as close as they are allowed to be to each other by the separation assurance functions, the sensor positions must be accounted for by subtracting the distance H from the actual distance, ΔP, between the cars. This can be accommodated by a constant, H, on a line 71 in the summer 75. Using the constant H facilitates merging of the comparison with the equations within the software (hereinafter), and allows easy modification of the allowed separation distance in the software.

The distance between the cars is obtained by subtracting the position of the lower car from the position of the upper car in a summer 75, to provide an actual distance signal, ΔP, on a line 76. The actual distance signal on the line 76 is fed to a pair of comparators 77, 78, for comparison with the outputs 79, 80 of the tables 66, 67. This may be done continuously or periodically, about every 0.15 seconds to 1.0 second. The means for comparison may in fact be within software, merged into the calculations, if desired.

In the present embodiment, a conditional engage brake signal on a line 85 may be applied to either or both of the upper car and the lower car in dependence on the present velocity of the respective car. To achieve this, each velocity signal V(U) on line 64 and V(L) on line 65 is applied to corresponding bilateral threshold detection functions 88, 89, and if the respective velocity is above a threshold, a related signal on a line 92, 93 enables a corresponding AND gate 94, 95 to produce a related engage brake signal, ENG BRK(U) on a line 98 or ENG BRK(L) on a line 99, respectively. The signals on the lines 98, 99 are applied, respectively, to the upper controller 45 (FIG. 1) and lower controller 46. In response to these signals, the corresponding controller 45, 46 will cause the holding current to the corresponding brake 49, 50 to be terminated, such as by opening the conventional safety chain, thus dropping the respective brake.

The condition under which the engage brake signals on lines 98 and 99 will be provided may be different from the velocity threshold described hereinbefore, as suits any given implementation of the present invention.

With respect to the stopping distance for the safeties, the output of the table 67 is applied to the comparator 78, the output of which may be used directly to engage safeties by enabling corresponding AND gates 103-106 to produce signal 82 in dependence upon an indication from bilateral level detectors 109, 110 of whether a car is traveling upwardly or downwardly. A positive output from one of the level detectors 109, 110 indicates a car is traveling upwardly, and therefore that the lower safeties 18 and 19 should be engaged. On the other hand, a negative output from the level detectors 109, 110 indicates that the corresponding car is traveling downwardly and so the upper safeties 18*a*, 19*a* should be engaged.

The engage safeties signal on the line 81 may be applied, as shown, to an OR gate 112, the other inputs of which on lines 113, 114 are from corresponding vertical acceleration sensors 117, 118, (FIG. 1) which provide a signal if the downward acceleration of the corresponding car reaches a threshold magnitude, and remains at that magnitude for a sufficient period of time to eliminate false tripping. This feature of the invention senses a free falling car and causes the engagement of the safeties of all cars in the hoistway as a consequence thereof. It is necessary to stop all cars, since a car not in freefall may be traveling toward the stopped car, beyond a point which is deemed safe by the dispatching and motion control software. This aspect of the invention may be utilized apart from the safe stopping distance aspect of the invention, and vice versa. If desired, acceleration may be differentiated from velocity; however, sensors 117, 118 will respond more quickly.

The processor 42 is as described with respect to FIG. 2 except for using signals from the lower sensors, L POS(U), L POS(L).

A signal on a line 98 from either of the processors 41, 42 can have its own individual effect on dropping the safety chain in the upper car's controller 45; similarly, a signal on either of the lines 99 can have its own individual effect dropping the safety chain in the lower car's controller 46. The engage safety signal on one of the lines 82 from either the processors 41, 42 will activate the appropriate safeties 18, 19 if the car is traveling upwardly or 18*a*, 19*a* if the car is traveling downwardly.

If desired, instead of two-dimensional tables 66, 67 followed by respective comparators 77, 78, three-dimensional tables, including actual distance, ΔP, as an input, may be used. Or, the invention may be implemented in other ways.

The brakes of the cars referred to herein may be conventional disk or drum brakes, rope grabbers, or other stopping devices. If there are more than two cars in a hoistway, the invention may be practiced with respect to each pair of adjacent cars; each car but the highest in the hoistway and the lowest in the hoistway being involved in more than one separation assurance comparison.

If desired, rather than deriving relative velocity from absolute position of the two cars, relative distance and velocity may be sensed more directly, such as by means of car-mounted, sonic, infrared or radio frequency devices, employing Doppler effect for relative velocity, with integration for instantaneous position which is referenced, at short intervals, to actual position readings.

The invention claimed is:

1. A method of operating an elevator system having at least one hoistway and a plurality of elevator cars traveling within said at least one hoistway, each car having brakes and safeties, said method comprising:

determining the car velocity of each car in said hoistway;

characterized by:

developing, for all possible combinations of velocity of each pair of adjacent cars in said hoistway, a braking distance which is greater by a predetermined amount than a safe braking distance for stopping one or both cars of each said pair of adjacent cars to maintain adequate separation;

developing, for all possible combinations of velocity of each said pair of adjacent cars, a stopping distance which is greater by a predetermined amount than a safe stopping distance for stopping both cars of each said pair of adjacent cars by means of safeties;

(a) periodically or (b) continuously determining the actual distance between cars of each said pair of adjacent cars;

providing at least one signal causing the brakes of one or more cars of a particular pair of adjacent cars to be applied in the event that said actual distance between said particular pair of adjacent cars is less than said braking distance corresponding to the contemporaneous velocities of said particular pair of adjacent cars;

providing an engage safeties signal indicative of said actual distance being less than said stopping distance corresponding to the contemporaneous velocities of a pair of adjacent cars; and providing signals to engage the safeties of all of said cars in said hoistway in response to said engage safeties signal wherein said braking distances are developed as:

$$\text{Stopping Distance}(B) = V(U)\Delta t + 1/2A(U)\Delta t^2 + [V(U) + A(U)\Delta t]^2/2D(U) + V(L)\Delta t + 1/2A(L)\Delta t^2 + [V(L) + A(L)\Delta t]^2/2D(U) + K(B)$$

Where K(B)=a braking distance bias constant, which is optional

V=velocity

A=acceleration, assumed from car overbalance

D=deceleration=$[F(B)-W_o]/m$

Where F(B)=force applied by brakes $W_o$=overbalance (net) weight of car m=mass of car plus counterweight and said stopping distances are developed in the same fashion as said braking distances except that force applied by the safeties is substituted for brake force and a safeties braking distance bias constant may either be (a) the same as or (b) different than said braking distance bias constant, or (c) omitted.

* * * * *